US009528788B2

(12) United States Patent
McPherson

(10) Patent No.: US 9,528,788 B2
(45) Date of Patent: Dec. 27, 2016

(54) ARCHERY BOW AXLE WITH FASTENER

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 14/814,005

(22) Filed: Jul. 30, 2015

(65) Prior Publication Data

US 2016/0033228 A1 Feb. 4, 2016

Related U.S. Application Data

(60) Provisional application No. 62/031,112, filed on Jul. 30, 2014.

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/14* (2013.01); *Y10S 124/90* (2013.01)

(58) Field of Classification Search
CPC ..... F41B 5/10; F41B 5/105; F41B 5/14; Y10S 124/90
USPC ..... 124/25.6, 86, 900
See application file for complete search history.

(56) References Cited

U.S. PATENT DOCUMENTS

| | | | | | |
|---|---|---|---|---|---|
| 1,348,767 | A | | 8/1920 | White | |
| 1,638,282 | A | | 8/1927 | Wood | |
| 3,055,100 | A | | 9/1962 | Kimpel | |
| 3,112,547 | A | | 12/1963 | Poe | |
| 3,486,495 | A | | 12/1969 | Allen | |
| 3,548,704 | A | | 12/1970 | Kutryk | |
| 4,064,862 | A | * | 12/1977 | Groner | F41B 5/10 124/25.6 |
| 4,192,280 | A | * | 3/1980 | Rickard | F41B 5/10 124/25.6 |
| RE30,445 | E | | 12/1980 | Ruhl | |
| 4,448,183 | A | * | 5/1984 | Quartino | F41B 5/10 124/25.6 |
| 4,461,267 | A | * | 7/1984 | Simonds | F41B 5/10 124/25.6 |
| 4,561,413 | A | * | 12/1985 | Jennings | F41B 5/10 124/25.6 |
| 4,660,536 | A | * | 4/1987 | McPherson | F41B 5/105 124/24.1 |
| 4,770,154 | A | * | 9/1988 | Cook | F41B 5/10 124/25.6 |
| 4,917,070 | A | | 4/1990 | Townsend | |
| 5,020,507 | A | * | 6/1991 | Larson | F41B 5/10 124/25.6 |
| 5,211,155 | A | * | 5/1993 | Zamojski | F41B 5/10 124/25.6 |
| 5,307,787 | A | * | 5/1994 | LaBorde | F41B 5/105 124/25.6 |
| 5,353,777 | A | * | 10/1994 | Fincher | F41B 5/10 124/16 |
| 5,368,006 | A | | 11/1994 | McPherson | |
| 5,373,959 | A | | 12/1994 | Haasewinkle | |

(Continued)

*Primary Examiner* — Alexander Niconovich

(57) ABSTRACT

In at least one embodiment, an archery bow comprises a limb and an axle assembly supported by the limb. The axle assembly comprises a shaft having a threaded portion and a fastener arranged to engage the threaded portion.

20 Claims, 16 Drawing Sheets

(56) References Cited

U.S. PATENT DOCUMENTS 5,381,777 A * 1/1995 Mitchell ..... F41B 5/105 124/23.1
5,390,655 A * 2/1995 Mitchell ..... F41B 5/10 124/25.6
5,425,286 A 6/1995 Laue
5,429,014 A 7/1995 Laue
5,535,727 A * 7/1996 Helmuth ..... F41B 5/10 124/25.6
5,636,956 A 6/1997 Emmett et al.
5,649,522 A 7/1997 Troncoso
5,672,036 A 9/1997 Medal
5,687,703 A * 11/1997 Vyprachticky ..... F41B 5/105 124/25.6
5,697,355 A * 12/1997 Schaffer ..... F41B 5/105 124/25.6
6,082,347 A 7/2000 Darlington
6,119,306 A 9/2000 Antonucci et al.
6,145,208 A 11/2000 Savage
6,415,780 B1 * 7/2002 Proctor ..... F41B 5/10 124/25.6
6,474,324 B1 * 11/2002 Despart ..... F41B 5/10 124/25.6
6,537,006 B1 3/2003 Clark
6,629,522 B2 * 10/2003 Andrews ..... F41B 5/10 124/25.6
6,786,214 B2 * 9/2004 Andrews ..... F41B 5/0026 124/23.1
6,871,643 B2 * 3/2005 Cooper ..... F41B 5/10 124/25.6
6,964,271 B2 * 11/2005 Andrews ..... F41B 5/10 124/25.6
6,990,970 B1 * 1/2006 Darlington ..... F41B 5/10 124/25.6
7,305,979 B1 12/2007 Yehle
7,441,555 B1 * 10/2008 Larson ..... F41B 5/10 124/25.6
7,637,256 B2 * 12/2009 Lee ..... F41B 5/105 124/25.6
7,938,109 B1 * 5/2011 Larson ..... F41B 5/10 124/25.6
7,971,582 B1 * 7/2011 Larson ..... F41B 5/10 124/25.6
7,980,235 B1 * 7/2011 Kronengold ..... F41B 5/14 124/1
8,069,848 B1 * 12/2011 Larson ..... F41B 5/10 124/25.6
8,281,773 B2 * 10/2012 Dahl, II ..... F41B 5/10 124/23.1
8,281,775 B1 * 10/2012 Larson ..... F41B 5/10 124/25.6
8,408,193 B2 * 4/2013 McPherson ..... F41B 5/105 124/25.6
8,528,534 B2 * 9/2013 McPherson ..... F41B 5/14 124/25.6
8,991,376 B2 * 3/2015 McPherson ..... F41B 5/10 124/1
9,115,953 B1 * 8/2015 Huang ..... F41B 5/10
2007/0193568 A1 8/2007 Lee
2010/0307471 A1 * 12/2010 McPherson ..... F41B 5/14 124/25.6
2011/0070049 A1 3/2011 Wang

* cited by examiner

ARCHERY BOW AXLE WITH FASTENER

CROSS-REFERENCE TO RELATED APPLICATIONS

This application claims the benefit of U.S. Provisional Patent Application No. 62/031,112, filed Jul. 30, 2014, the entire content of which is hereby incorporated herein by reference.

BACKGROUND OF THE INVENTION

This invention relates to archery bows having axles. Compound bows are known in the art and typically include rotating members that are supported by axles. Each axle is typically supported by a bow limb.

Prior art axles generally have a predetermined length and a single groove at each end. The length of an axle is generally greater than the width of a limb that supports the axle, allowing the grooved end portions of the axle to protrude from the limb. Each groove accepts a retaining clip, often a spring tension clip having an E-configuration. The E-clips lock onto the axle grooves and abut the outer sides of the limb, thereby securing the axle in place.

Although the E-clips or other resiliently deformable snap-on clips are generally secure, assembly and disassembly can cause fatigue as the clips are repeatedly deformed. Additionally, a large impact load applied to a bow might inadvertently deform a clip, potentially causing it to release from the axle groove.

There remains a need for novel archery bow axle arrangements that are more secure than prior arrangements.

There remains a need for novel archery bow axle arrangements that allow for greater precision in locating the axle and items supported by the axle (e.g. rotating member) with respect to items that support the axle (e.g. limb members). There remains a need for novel archery bow axle arrangements that allow for greater precision in locating and positioning limbs, axles, rotating members and/or bearings when compared to prior art designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, an archery bow comprises a limb and an axle assembly supported by the limb. The axle assembly comprises a shaft and a fastener. The shaft comprises a threaded portion and the fastener is arranged to engage the threaded portion.

In some embodiments, the fastener comprises a screw that is received in a cavity in the shaft.

In some embodiments, one or more bushings are used between the limb and the shaft.

In some embodiments, the shaft supports a bearing comprising a first portion and a second portion moveable with respect to the first portion. The shaft contacts the second portion and the first portion contacts a rotatable member. In some embodiments, the rotatable member does not contact the shaft directly.

In some embodiments, the shaft extends through an aperture in the limb.

In some embodiments, the shaft is supported by a pillow block, and the pillow block is supported by the limb.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
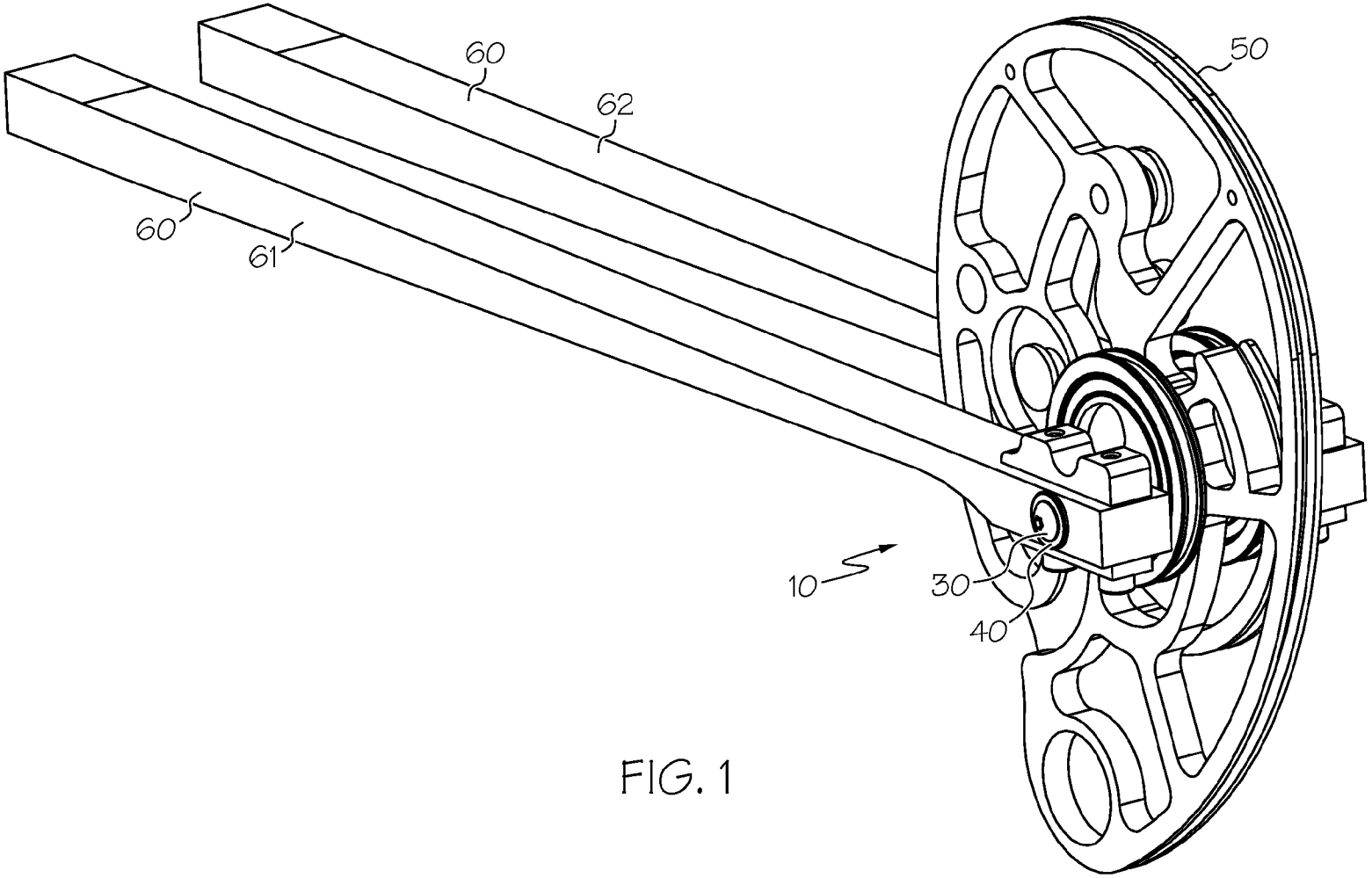
FIG. 1 shows an embodiment of an axle assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
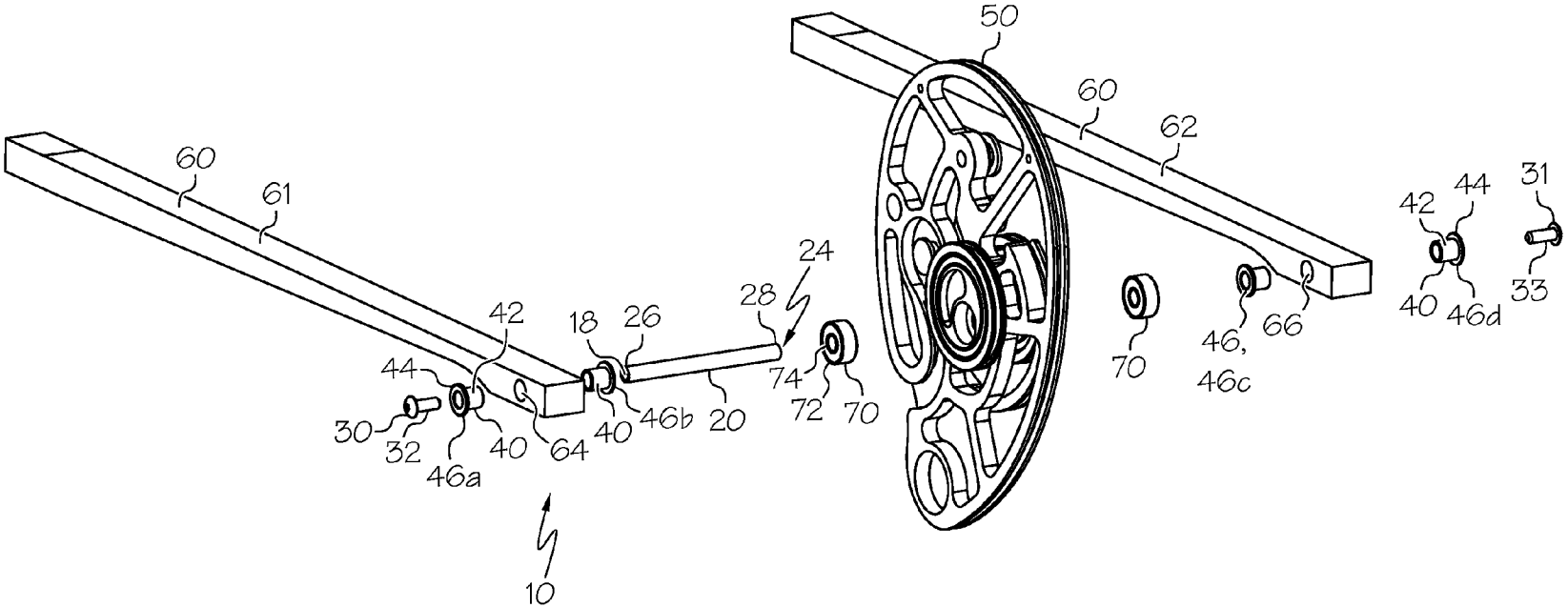
FIG. 2 shows an embodiment of an axle assembly in exploded view.

FIG. 1 shows an embodiment of an archery bow axle assembly 10. FIG. 2 shows an exploded view of an embodiment of an archery bow axle assembly 10. The axle assembly 10 desirably supports a rotatable member 50 of an archery bow, and is supported a bow limb 60. The limb 60 is typically supported by a riser (not shown) as known in the art.

In some embodiments, a limb 60 comprises a single limb member having a forked end portion. As shown in FIG. 1, the limb 60 comprises a split-limb assembly having a first limb portion 61 and a second limb portion 62.

In some embodiments, the axle assembly 10 comprises a shaft 20 and at least one fastener 30 arranged to engage the shaft 20. In some embodiments, the shaft 20 comprises at least one threaded portion 22 and the fastener 30 comprises a threaded portion 32 arranged to engage one another. In some embodiments, a threaded portion 22 is located at a first end 26 of the shaft 20, and the fastener 30 is arranged to engage the first end 26.

In some embodiments, the first end 26 comprises a cavity 18, and a portion of the fastener 30 is received in the cavity 18. In some embodiments, the threaded portion 22 comprises internal threading within the cavity 18.

In some embodiments, a fastener 30 comprises external threading. In some embodiments, a fastener 30 comprises a screw, such as a machine screw.

In some embodiments, a limb 60 comprises an aperture 64 and the shaft 20 extends into the aperture 64. In some embodiments, the shaft 20 extends through the aperture 64. Desirably, the fastener 30 attaches to the shaft 20 and prevents the shaft 20 from disengaging the limb 60. In some embodiments, the fastener 30 comprises a flange, head or other surface sized larger than the aperture 64.

In some embodiments, the shaft 20 comprises a second threaded portion 24, for example located at a second end 28. In some embodiments, the second threaded portion 24 comprises a cavity having internal threading.

In some embodiments, a second fastener 31 is configured for attachment to the second end 28 of the shaft 20. In some embodiments, the shaft 20 extends into a second aperture 66 in the limb 60. In some embodiments, the shaft 20 extends through the second aperture 66. In some embodiments, a portion of the second fastener 31 is received in a cavity at the second end 28.

In some embodiments, a second fastener 31 comprises external threading. In some embodiments, a second fastener 31 comprises a screw, such as a machine screw. Desirably, the second fastener 31 attaches to the second end 28 of shaft 20.

In some embodiments, a first fastener 30 and a second fastener 31 engage the respective opposed ends 26, 28 of the shaft 20 and collectively fasten the axle assembly 10 to the limb 60. In some embodiments, the first fastener 30 and second fastener 31 are similar to one another, for example comprising a similar part.

In some embodiments, one or more bearing members 40 are positioned between the limb 60 and the axle assembly 10. In some embodiments, a bearing member 40 is received in an aperture 64, 66 in the limb 60. In some embodiments, a bearing member 40 comprises a bushing. In some embodiments, a bearing member 40 comprises a tubular portion 42, and the shaft 20 extends into the tubular portion 42. In some embodiments, the shaft 20 extends through the tubular portion 42. In some embodiments, a cross-sectional shape of the tubular portion 42 is similar to a cross-sectional shape of the shaft 20.

In some embodiments, a bearing member 40 comprises a flange 44, for example comprising a flanged bushing 46. In some embodiments, the flange 44 of a bearing member 40 comprises a bearing surface located between a limb 60 and a fastener 30, 31. In some embodiments, the flange 44 comprises a bearing surface located between a limb 60 and a rotatable member 50, or between a limb 60 and a bearing 70 that supports a rotatable member 50.

In some embodiments, a tubular portion 42 of a first flanged bushing **46*a* is positioned in an aperture 64 of a first limb portion 61, and the flange 44 of the first flanged bushing 46*a* is positioned between a sidewall of the first limb portion 61 and the first fastener 30. A tubular portion 42 of a second flanged bushing 46*a* is also received in the aperture 64, for example being inserted in the other side. The flange 44 of the second flanged bushing 46*b* is positioned between a sidewall of the first limb portion 61 and the rotatable member 50. A tubular portion 42 of a third flanged bushing 46*c* is positioned in an aperture 66 of a second limb portion 62, and the flange 44 of the third flanged bushing 46*c* is positioned between a sidewall of the second limb portion 66 and the rotatable member 50. A tubular portion 42 of a fourth flanged bushing 46*d* is also received in the aperture 66, for example being inserted in the other side. The flange 44 of the fourth flanged bushing 46*d* is positioned between a sidewall of the second limb portion 62 and the second fastener 31**.

In some embodiments, one or more bearings 70 are positioned between the rotatable member 50 and the shaft 20 of the axle assembly 10. In various embodiments, the bearing(s) 70 can be considered a portion of the rotatable member 50 or can be considered a portion of the axle assembly 10.

In some embodiments, a bearing 70 comprises a first portion 72 that is moveable (e.g. rotatable) with respect to a second portion 74. For example, in some embodiments, the first portion 72 comprises an outer race and the second portion 74 comprises an inner race moveable with respect to the outer race. In some embodiments, a bearing 70 comprises a rolling bearing, for example comprising rolling elements such as ball bearings, needle bearings, etc.

In some embodiments, the shaft 20 extends through the bearing 70 and contacts the inner portion 74 of the bearing 70. The outer portion 72 of the bearing 70 contacts the rotatable member 50. In this arrangement, the inner portion 74 tends to remain fixed with respect to the shaft 20 and the outer portion 72 tends to remain fixed with respect to the rotatable member 50. As the rotatable member 50 rotates with respect to the shaft 20, the inner portion 74 of the bearing 70 rotates with respect to the outer portion 72.

In some embodiments, a bearing 40 such as a flanged bushing 46 contacts a bearing 70 that supports the rotatable member 50. In some embodiments, the flange 44 of a flanged bushing 46 contacts the inner/second portion 74 of the bearing 70. In some embodiments, the flange 44 of the flanged bushing 46 does not contact the outer/first portion 72 of the bearing 70. For example, the flange 44 can have a diameter that is greater than an outermost diameter of the inner/second portion 74 but less than an innermost diameter of the outer/first portion 72 of the bearing 70. Thus, the flange 44 contacts elements that are considered non-moving with respect to the shaft 20 (e.g. limb 60, inner/second portion 74 of the bearing 70), but does not contact elements considered moveable with respect to the shaft 20 (e.g. rotatable member 50, outer/first portion 72 of the bearing 70).

Figure 3:
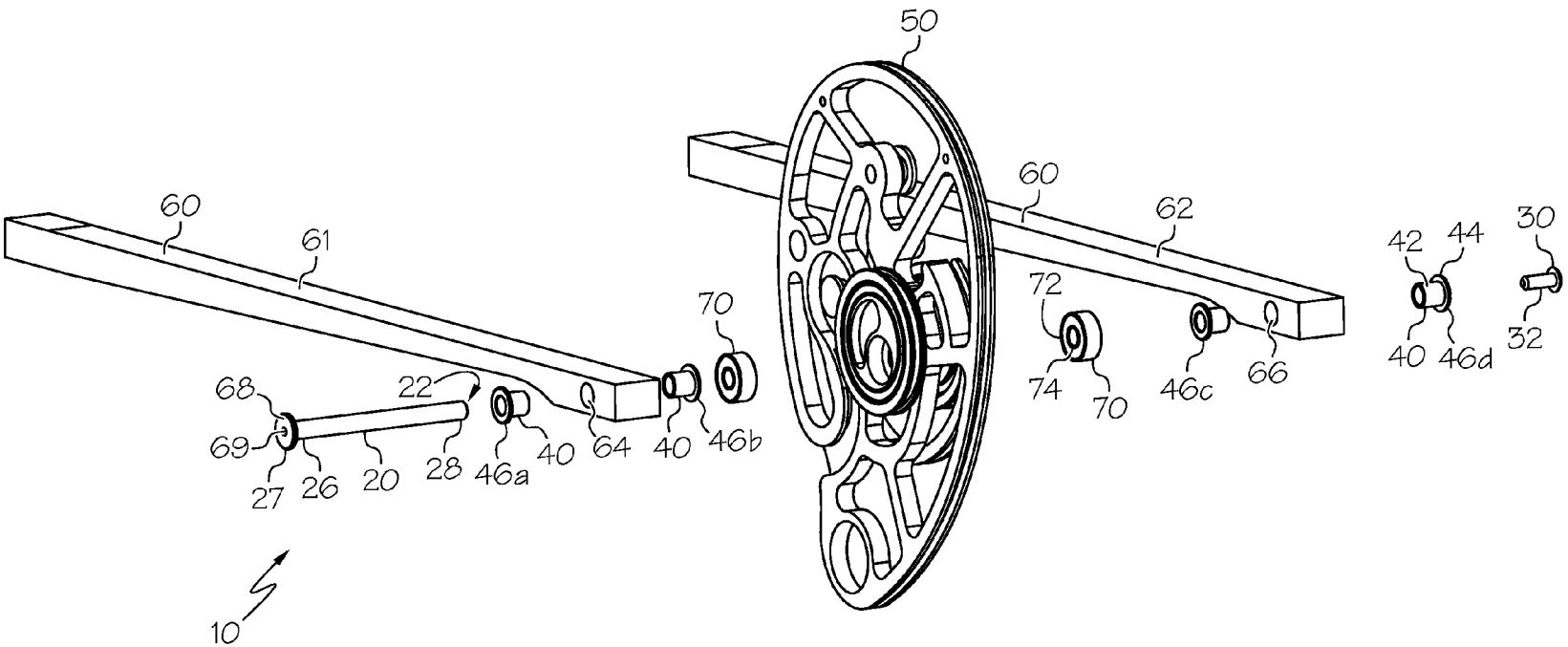
FIG. 3 shows another embodiment of an axle assembly in exploded view.

FIG. 3 shows another embodiment of an axle assembly 10, in an exploded view. Like reference characters in the Figures refer to like features.

In some embodiments, the axle shaft 20 comprises a first end 26 comprising a flange 27 or head 68 formed integrally with the shaft 20. In some embodiments, the head 68 is configured for engagement with a tool, for example comprising a hexagonal shape (e.g. bolt head), one or more slots (e.g. flathead and phillips), a shaped cavity 69 (e.g. allen or torx), etc.

In some embodiments, the second end 28 of the axle shaft 20 comprises a threaded portion 22 arranged to receive a fastener 30. Thus, in some embodiments, the head 68 of the shaft 20 and the fastener 30 can be engaged and tightened against one another.

In some embodiments, the axle shaft 20 comprises a binding post, shoulder screw, flanged captive standoff, barrel nut or the like.

Figure 4:
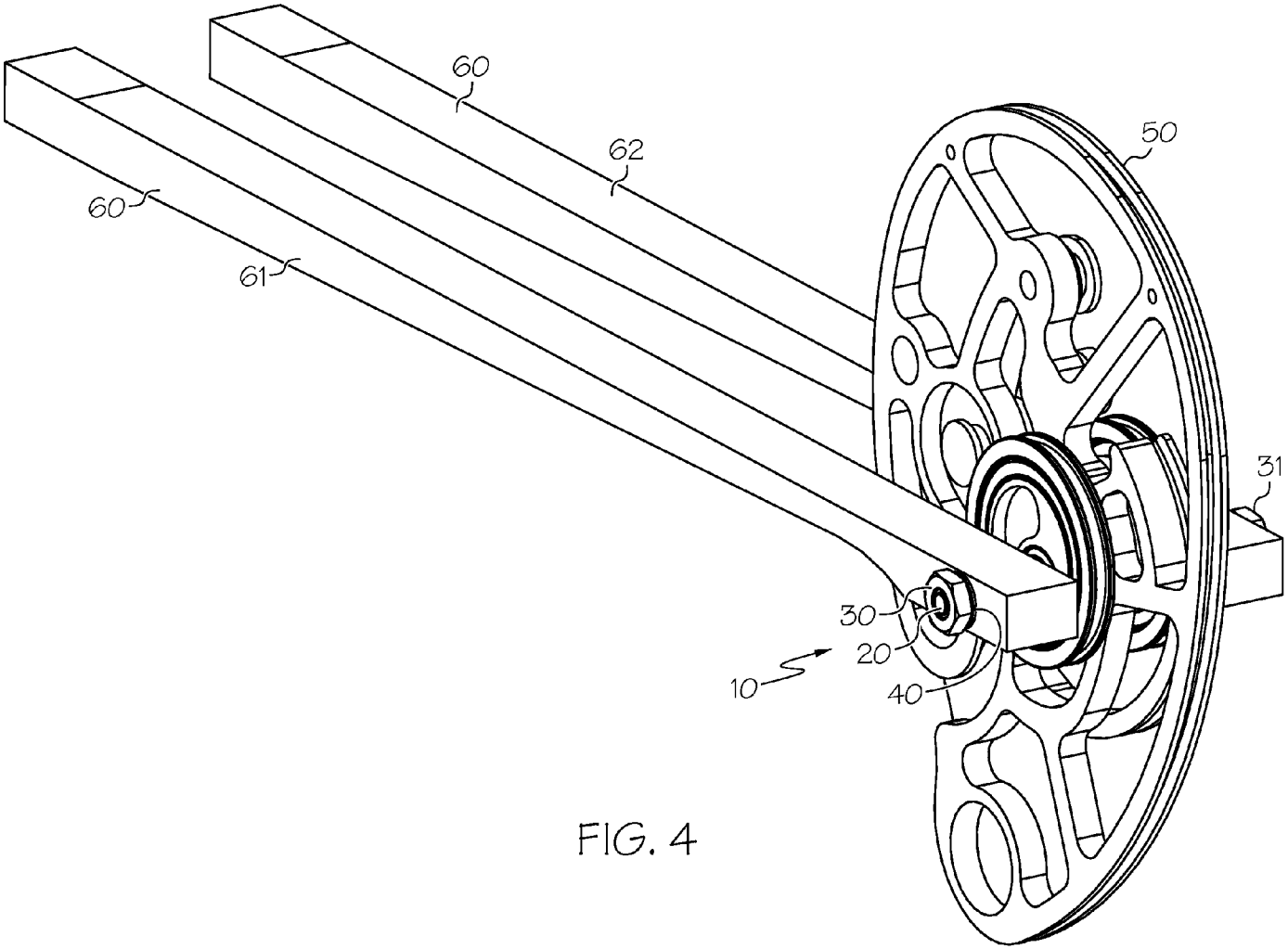
FIG. 4 shows another embodiment of an axle assembly.
Figure 5:
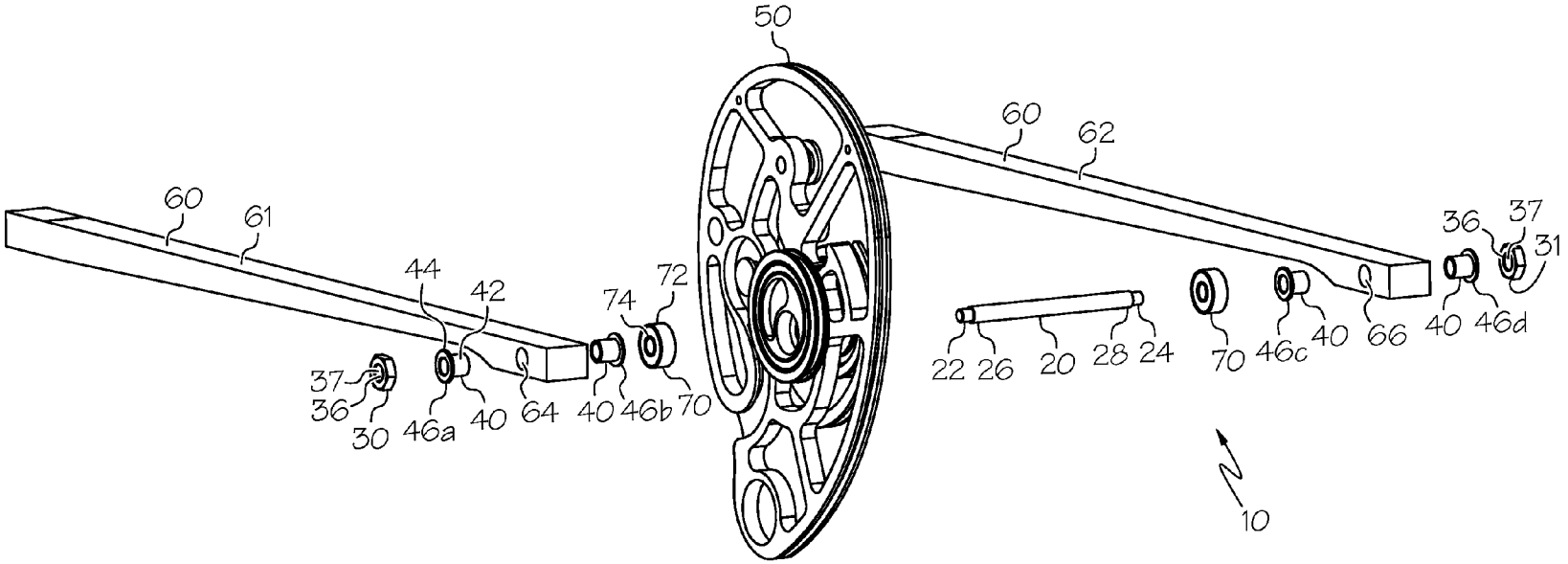
FIG. 5 shows another embodiment of an axle assembly in exploded view.

FIG. 4 shows another embodiment of an axle assembly 10. FIG. 5 shows another embodiment of an axle assembly 10 in exploded view. Like reference characters in the Figures refer to like features.

In some embodiments, the shaft 20 comprises a first end 26 having a threaded portion 22, wherein the threads are external, for example comprising an outer surface of the first end 26. In some embodiments, the shaft 20 comprises a second end 28 having a second threaded portion 24, wherein the threads are external, for example comprising an outer surface of the second end 28. In some embodiments, the shaft 20 comprises a hardened shaft with threaded ends.

In some embodiments, a fastener 30 comprises an aperture 36 and internal threads 37 configured to engage the shaft 20. In some embodiments, a fastener 30 comprises a nut, such as a hex nut, a lock nut, etc. In some embodiments, a fastener 30 comprises a cavity having internal threads, such as an acorn nut.

In some embodiments, a second fastener 31 comprises an aperture 36 and internal threads 37 configured to engage the shaft 20, for example at the second end 28.

Figure 6:
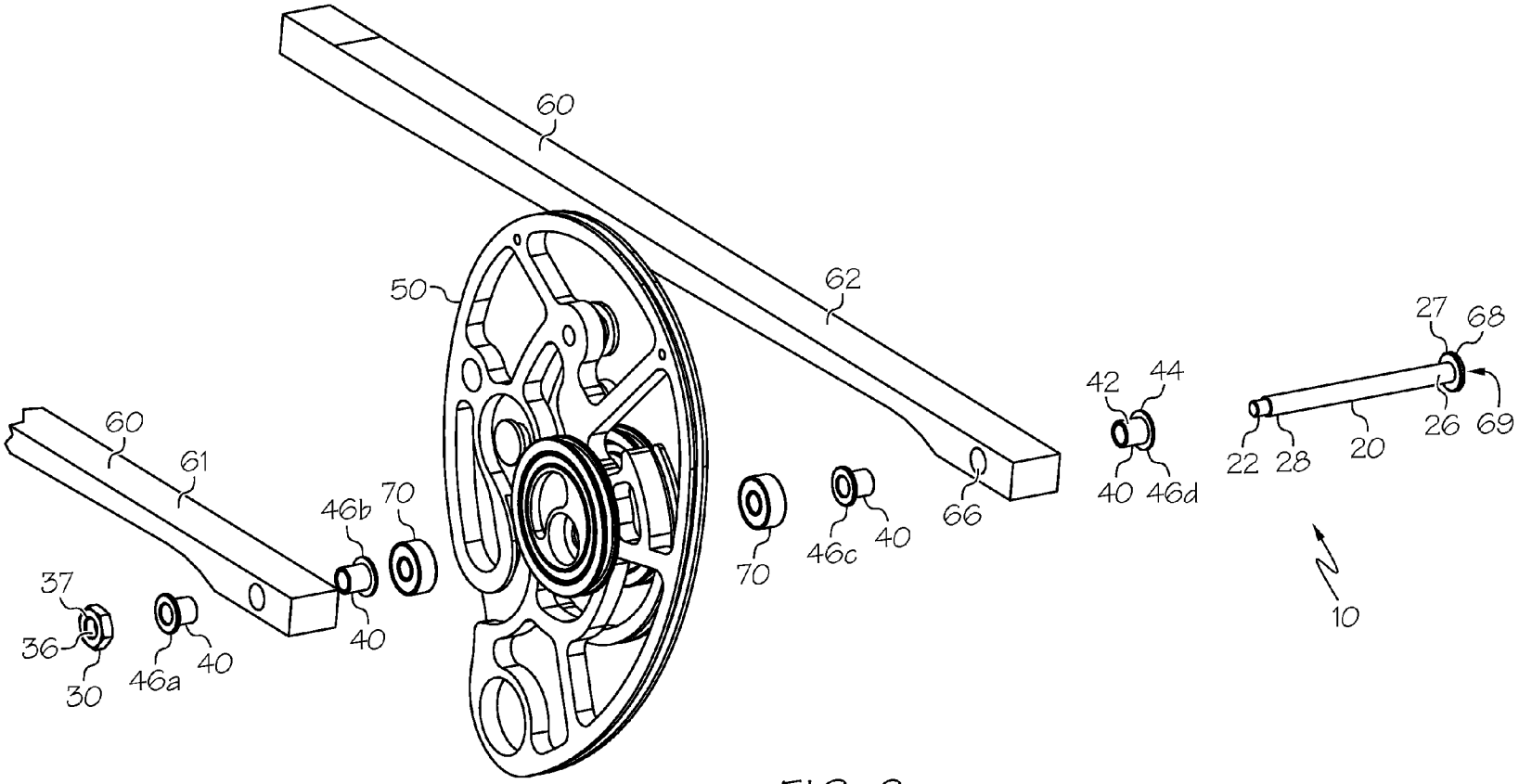
FIG. 6 shows another embodiment of an axle assembly in exploded view.

FIG. 6 shows another embodiment of an axle assembly 10. Like reference characters in the Figures refer to like features.

In some embodiments, the axle shaft 20 comprises a first end 26 comprising a flange 27 or head 68 formed integrally with the shaft 20. In some embodiments, the head 68 is configured for engagement with a tool, for example comprising a hexagonal shape (e.g. bolt head), one or more slots (e.g. flathead and phillips), a shaped cavity 69 (e.g. allen or torx), etc.

In some embodiments, the second end 28 of the axle shaft 20 comprises a threaded portion 22 arranged to receive a fastener 30. In some embodiments, the threaded portion 22 comprises external threads. In some embodiments, the axle shaft 20 comprises a shoulder screw.

In some embodiments, a fastener 30 comprises an aperture 36 and internal threads 37 configured to engage the threaded portion 20 of the shaft 20.

Figure 7:
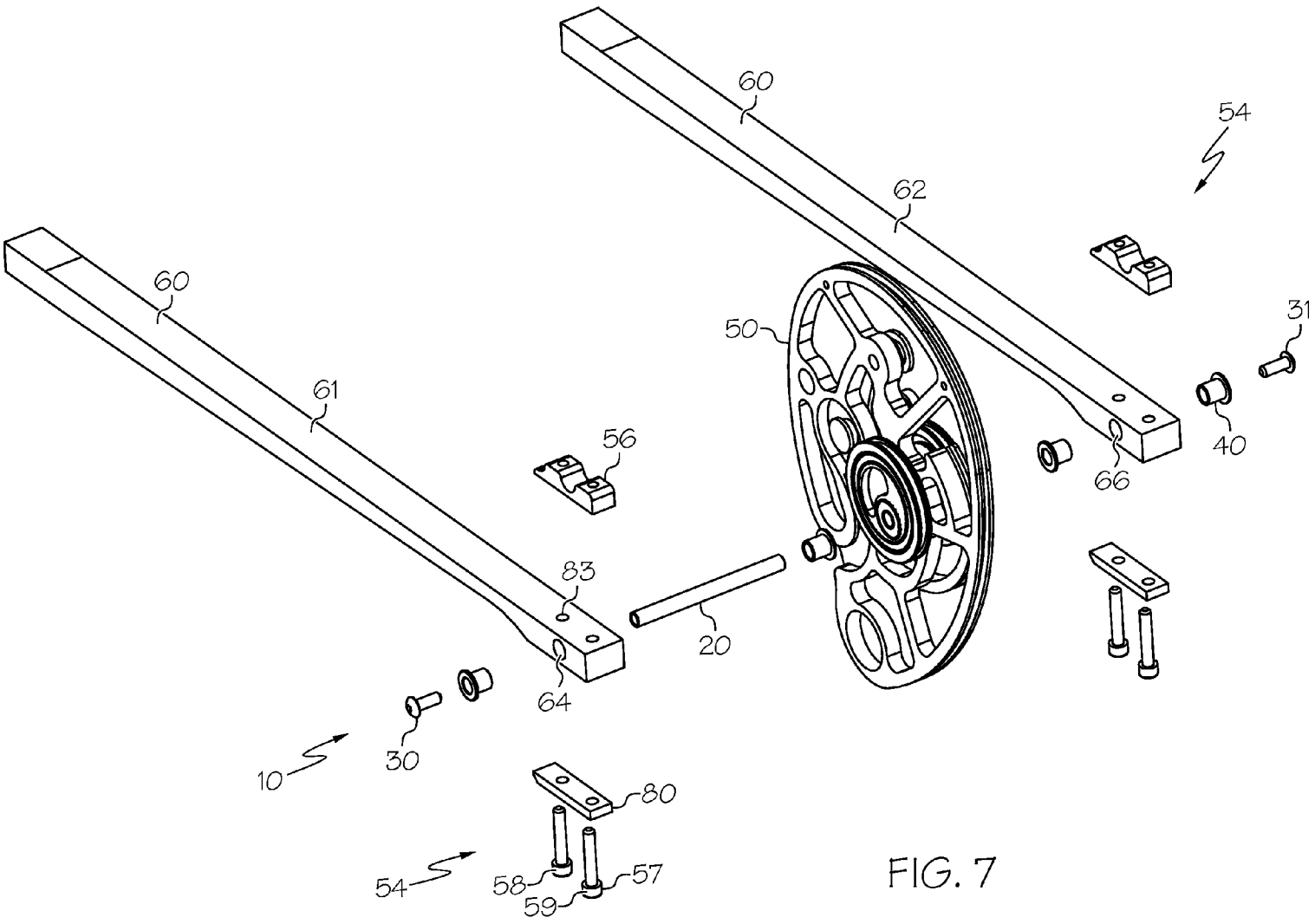
FIG. 7 shows an embodiment of an axle assembly and an embodiment of a limb reinforcing assembly.

FIG. 7 shows an embodiment of an axle assembly 10 and limb portions 61, 62 that are each reinforced. The limb 60 can experience high loads where it interacts with portions of the axle assembly 10, such as the shaft 20. It may be desirable to reinforce the limb 60, especially when relatively large apertures 64, 66 are used.

In some embodiments, a reinforcing assembly 54 comprises a plate 56 and at least one fastener 57. Desirably, the fastener 57 and plate 56 are used to place a portion of the limb 60 in compression. In some embodiments, the fastener 57 extends through a borehole 82 formed in the limb 60, such that a flange 59 or head of the fastener 57 abuts a surface of the limb 60, and the fastener 57 engages the plate 56 located on an opposing surface. The reinforcing assembly 54 applies compression between the two limb 60 surfaces.

In some embodiments, the borehole 82 is oriented orthogonal to an aperture 64 through which the shaft 20 passes.

In some embodiments, a reinforcing assembly 54 comprises a second fastener 58 arranged to engage the plate 56. In some embodiments, the second fastener 58 extends through a second borehole 83 formed in the limb 60. In some embodiments, the first borehole 82 and the second borehole 83 are located on opposite sides of the aperture 64. In some embodiments, the first fastener 57 and the second fastener 58 are located on opposite sides of the aperture 64.

In some embodiments, a reinforcing assembly 54 further comprises a load distribution plate 80, which can be placed between the fastener(s) 57, 58 and the limb 60. This distributes the load(s) applied by the fastener(s) 57, 58 to the limb 60 across the area of the load distribution plate 80.

In some embodiments, a reinforcing assembly 54 is used on a first limb portion 61, and another reinforcing assembly 54 is used on a second limb portion 62.

In some embodiments, a plate 56 comprises a bearing block arranged to engage a bow press, for example defining a cavity, for example as disclosed in U.S. Pat. No. 8,505,526, the entire content of which is incorporated herein by reference.

Figure 8:
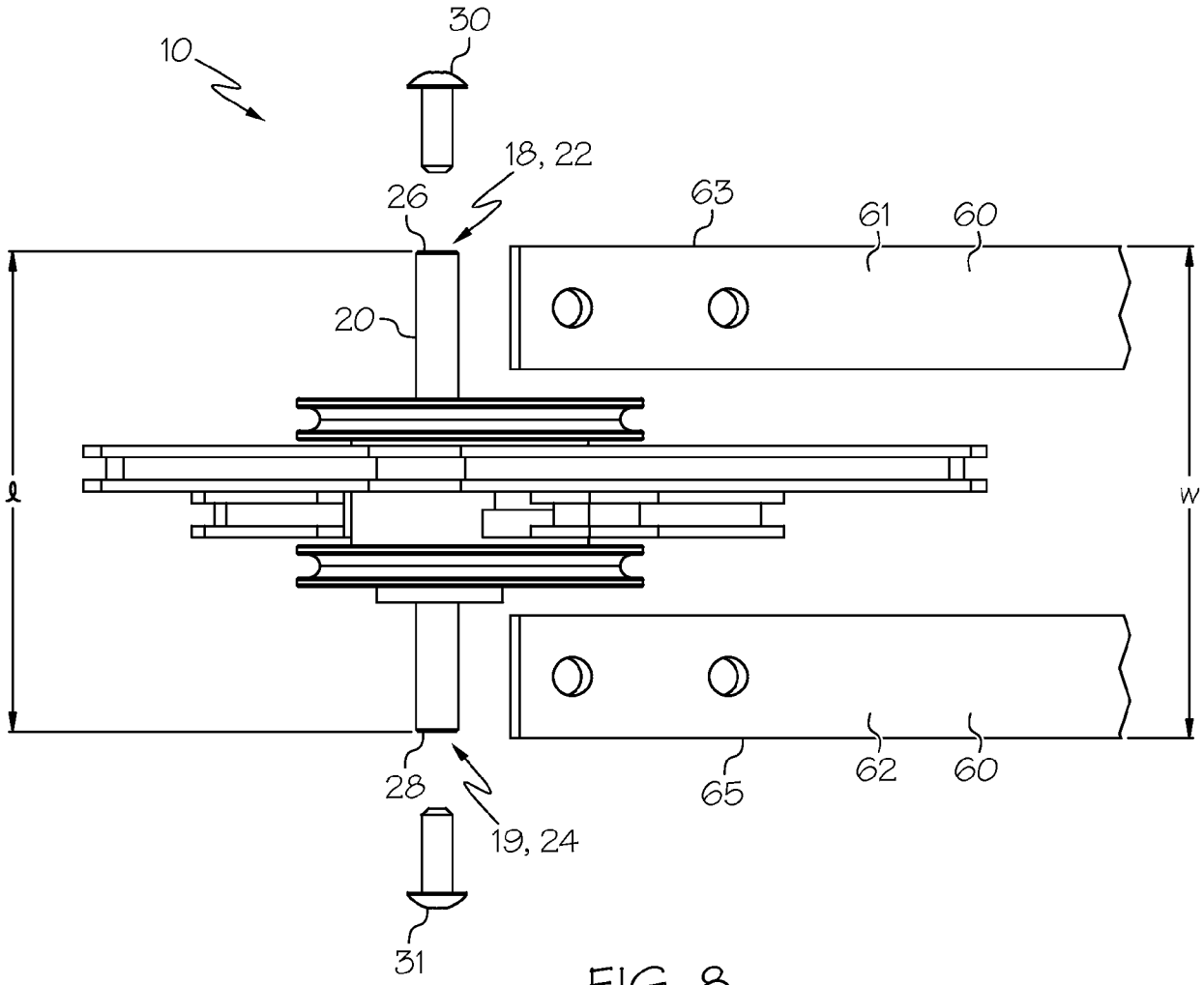
FIG. 8 shows an embodiment of an axle assembly with the limb spaced apart from the axle assembly.

FIG. 8 shows an embodiment of an axle assembly 10 having a shaft 20 having a first cavity 18 located at a first end 26 and a second cavity 19 located at the second end 28. The first cavity 18 comprises a first threaded portion 22, and is arranged to receive the first fastener 30. The second cavity comprises a second threaded portion 24, and is arranged to receive the second fastener 31.

The shaft 20 defines a length 1, for example a distance between the first end 26 and the second end 28.

The limb 60 defines a width w, for example a distance between a first outer side 63 of the limb 60 and a second outer side 65 of the limb 60. In embodiments where multiple limb portions (e.g. 61, 62) comprise a limb 60, the limb width w can be considered the distance from an outer side 63 of the first limb portion 61 to an outer side 65 of the second limb portion 62.

In some embodiments, the shaft 20 is oriented orthogonal to a length of the limb 60. In some embodiments, the shaft 20 length/is measured in a direction parallel to the limb 60 width w.

In some embodiments, the length/of the shaft 20 is equal to the width w of the limb 60.

In some embodiments, the length/of the shaft 20 is less than the width w of the limb 60, for example as shown in FIG. 8. This allows the axle assembly 10 to be tightened against the limb 60, thereby eliminating any excess space between components (e.g. rotating members, bearings, etc.) located between the limb portions 61, 62. The elimination of excess space provides for a zero tolerance situation and keeps the components in proper orientation over time. This also allows a fastener 30 to be used as a mechanism for adjusting fitment between the components and the limb portions 61, 62.

In some embodiments, the length/of the shaft 20 ranges from being 0.04" to 0.1" shorter than the width w of the limb 60.

In some embodiments, a thread locking compound is used between the shaft 20 and a fastener 30, 31.

Figure 9:
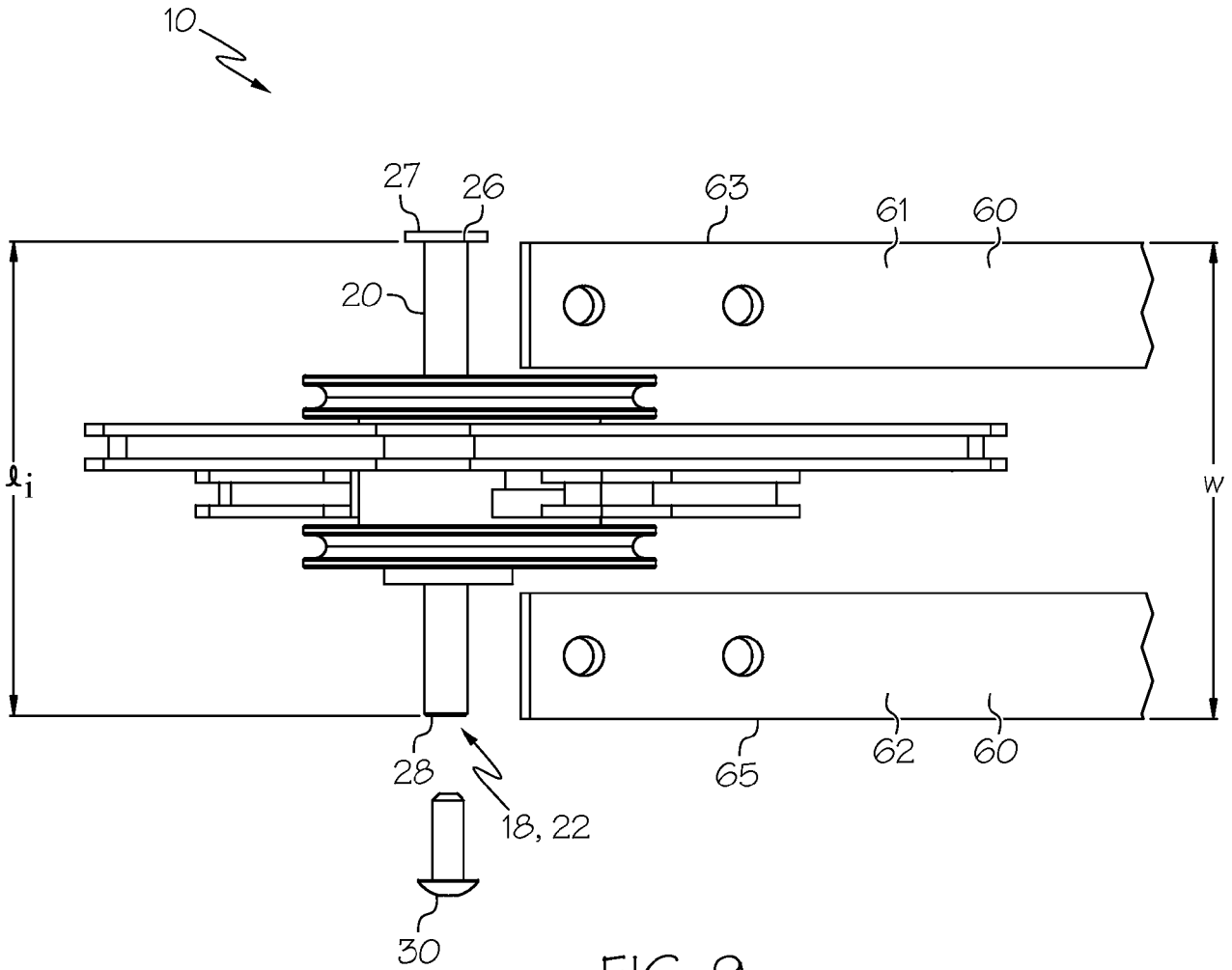
FIG. 9 shows another embodiment of an axle assembly with the limb spaced apart from the axle assembly.

FIG. 9 shows an embodiment of an axle assembly 10 having a shaft 20 that comprises a binding post, shoulder screw or the like. The shaft 20 comprises a first end 26 having a flange 27 and a second end 28 comprising a cavity 18 comprising a threaded portion 22. The cavity 18 is arranged to receive a fastener 30.

The shaft 20 defines an interior length 4, for example a distance between the inside portion of the flange 27 and the second end 28.

The limb 60 defines a width w, for example a distance between a first outer side 63 of the limb 60 and a second outer side 65 of the limb 60. In embodiments where multiple limb portions (e.g. 61, 62) comprise a limb 60, the limb width w can be considered the distance from an outer side 63 of the first limb portion 61 to an outer side 65 of the second limb portion 62.

In some embodiments, the interior length 4 of the shaft 20 is equal to the width w of the limb 60.

In some embodiments, the interior length 4 of the shaft 20 is less than the width w of the limb 60, for example as shown in FIG. 9. This allows the axle assembly 10 to be tightened against the limb 60, thereby eliminating excess space between components as discussed above. In some embodiments, the interior length 4 of the shaft 20 ranges from being 0.04" to 0.1" shorter than the width w of the limb 60.

Figure 10:
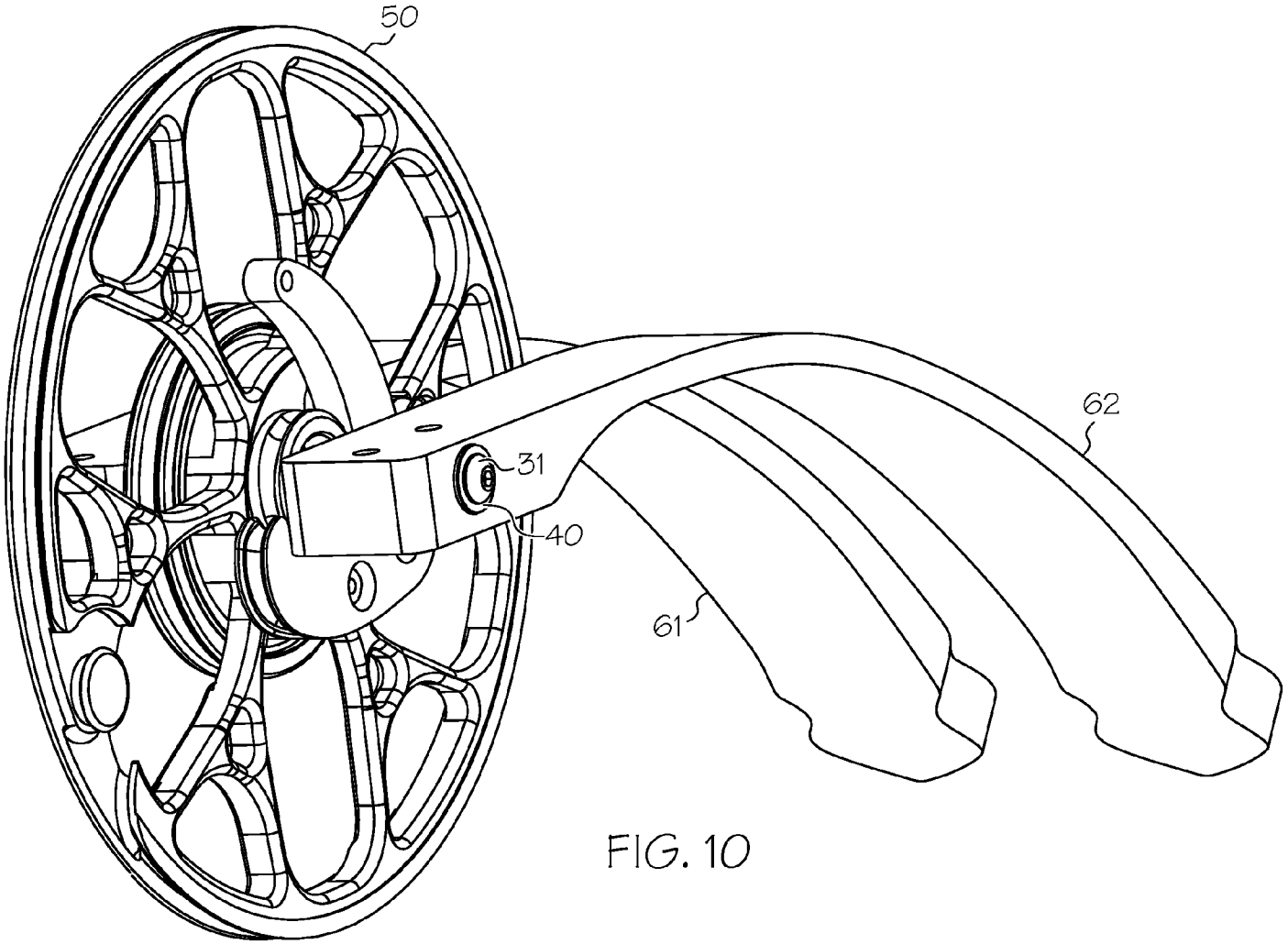
FIG. 10 shows another embodiment of an axle assembly and rotatable member.
Figure 11:
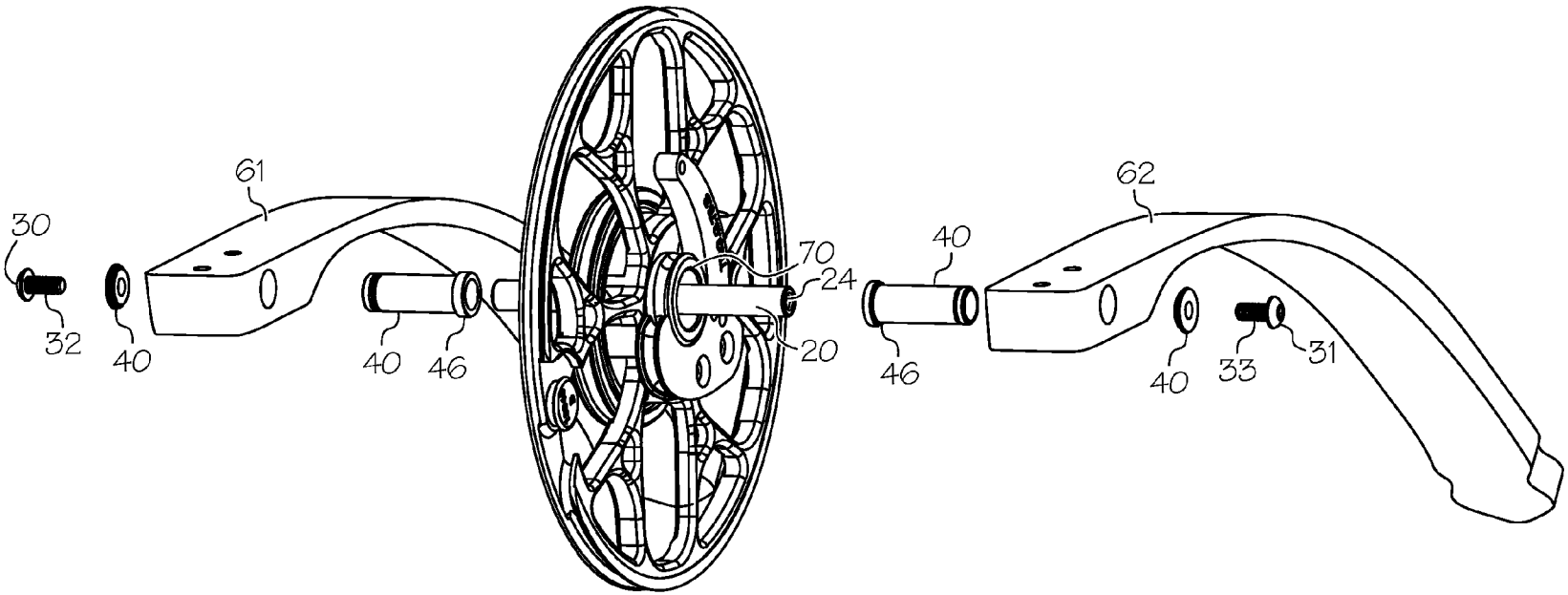
FIG. 11 shows an exploded view of the embodiment of FIG. 10.
Figure 12:
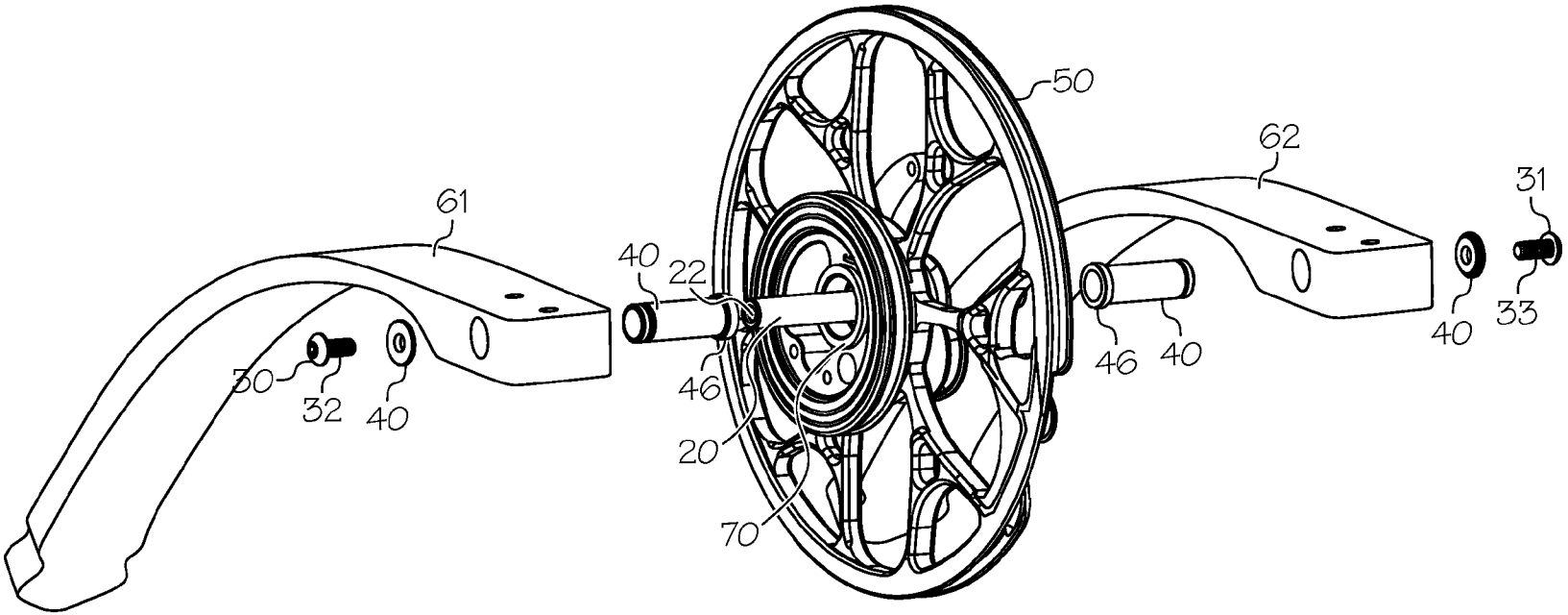
FIG. 12 shows another exploded view of the embodiment of FIG. 10 from a different viewing angle.

FIG. 10 shows another embodiment of an axle assembly. In some embodiments, a rotatable member 50 comprises a structure as described in U.S. patent application Ser. No. 14/725,468, the entire content of which is hereby incorporated herein by reference. FIG. 11 shows an exploded view of the components shown in FIG. 10. FIG. 12 shows an exploded view from another viewing angle.

In some embodiments, a limb portion 61, 62 comprises a width, and a bearing member 40, such as a flanged bushing 46, comprises a length that occupies a substantial portion of the limb width.

Figure 13:
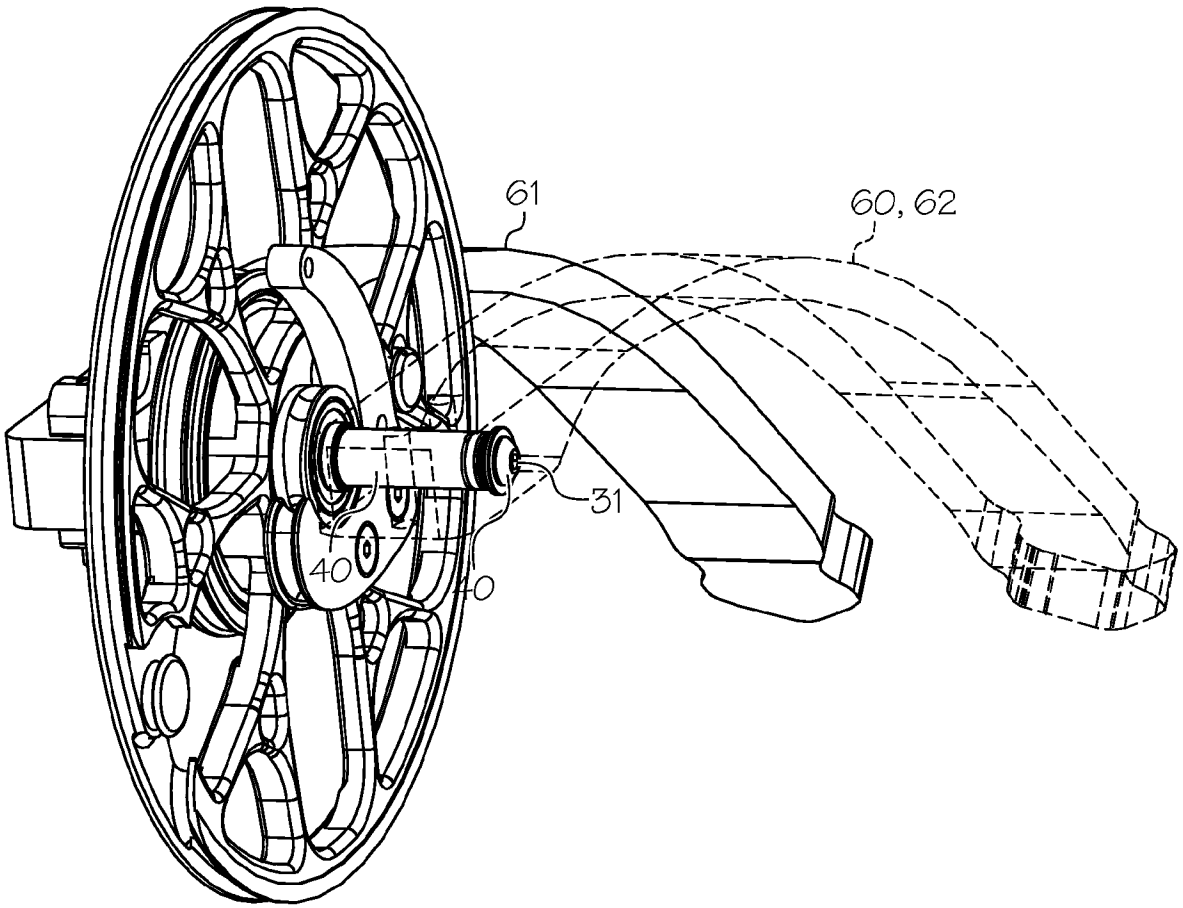
FIG. 13 shows another view of the embodiment of FIG. 10.

FIG. 13 shows the assembly of FIG. 10 with a limb 60 shown as hidden. A bearing member 40 is used on each side of the second limb portion 62. In some embodiments, the bearing members 40 used on opposite sides of a limb portion 61, 62 will contact one another. For example, the bearing members 40 can contact one another within the limb 62.

Figure 14:
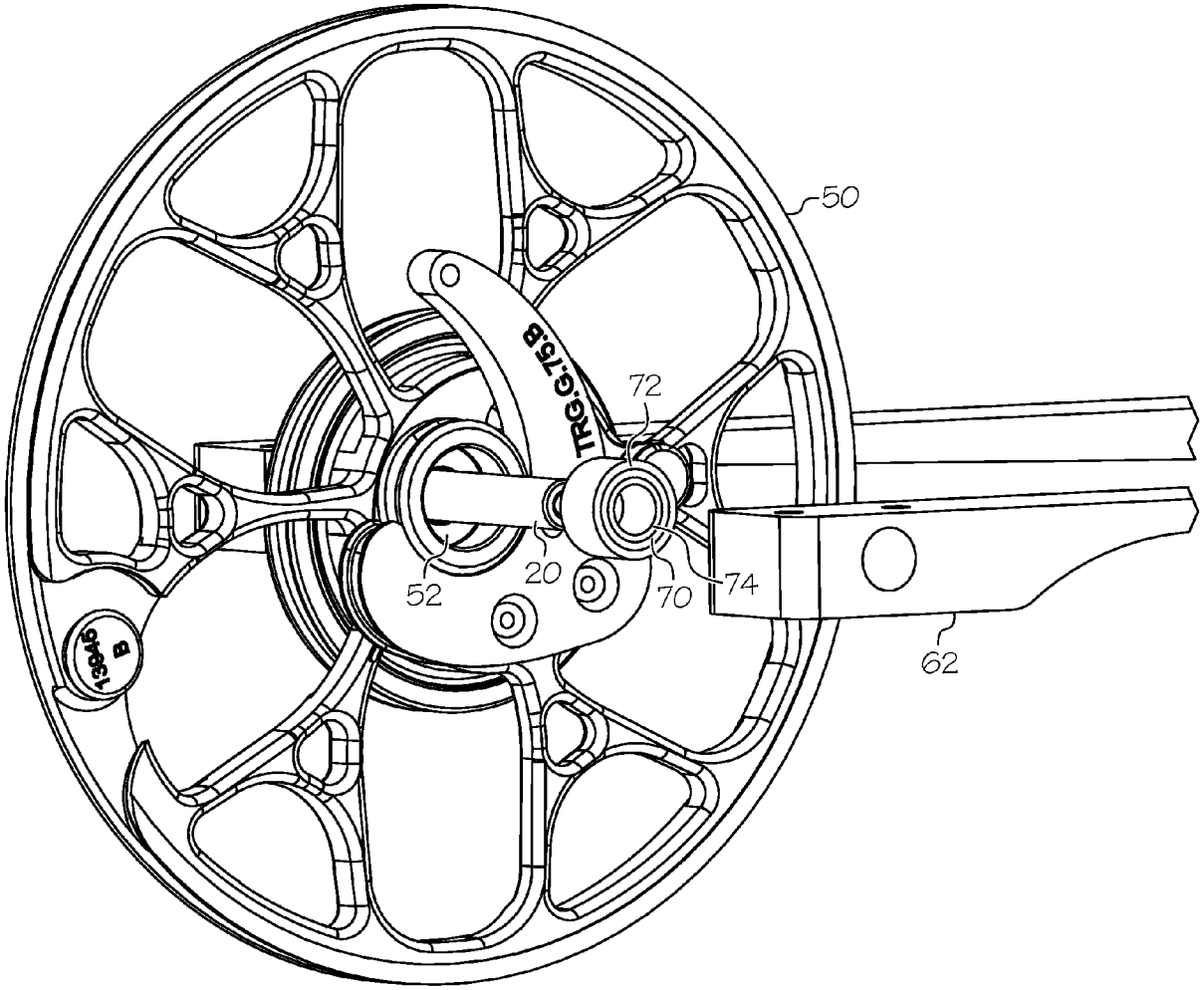
FIG. 14 shows an exploded view detail of a portion of the embodiment shown in FIG. 10.

FIG. 14 shows another exploded view of the assembly of FIG. 10. In some embodiments, the axle shaft 20 extends through the rotatable member 50 but does not contact the rotatable member 50. In some embodiments, the rotatable member 50 includes an inner portion 52 that surrounds the shaft 20, but a gap remains and the inner portion 52 does not contact the shaft 20. In some embodiments, the rotatable member 50 is supported by one or more bearings 70, wherein the bearing 70 contacts the shaft 20 and also contacts the rotatable member 50. In some embodiments, a bearing 70 comprises a first portion 72 that is rotatable with respect to a second portion 74. In some embodiments, a bearing 70 comprises a roller bearing. In some embodiments, the first portion 72 contacts the rotatable member 50 and the second portion 74 contacts the shaft.

Figure 15:
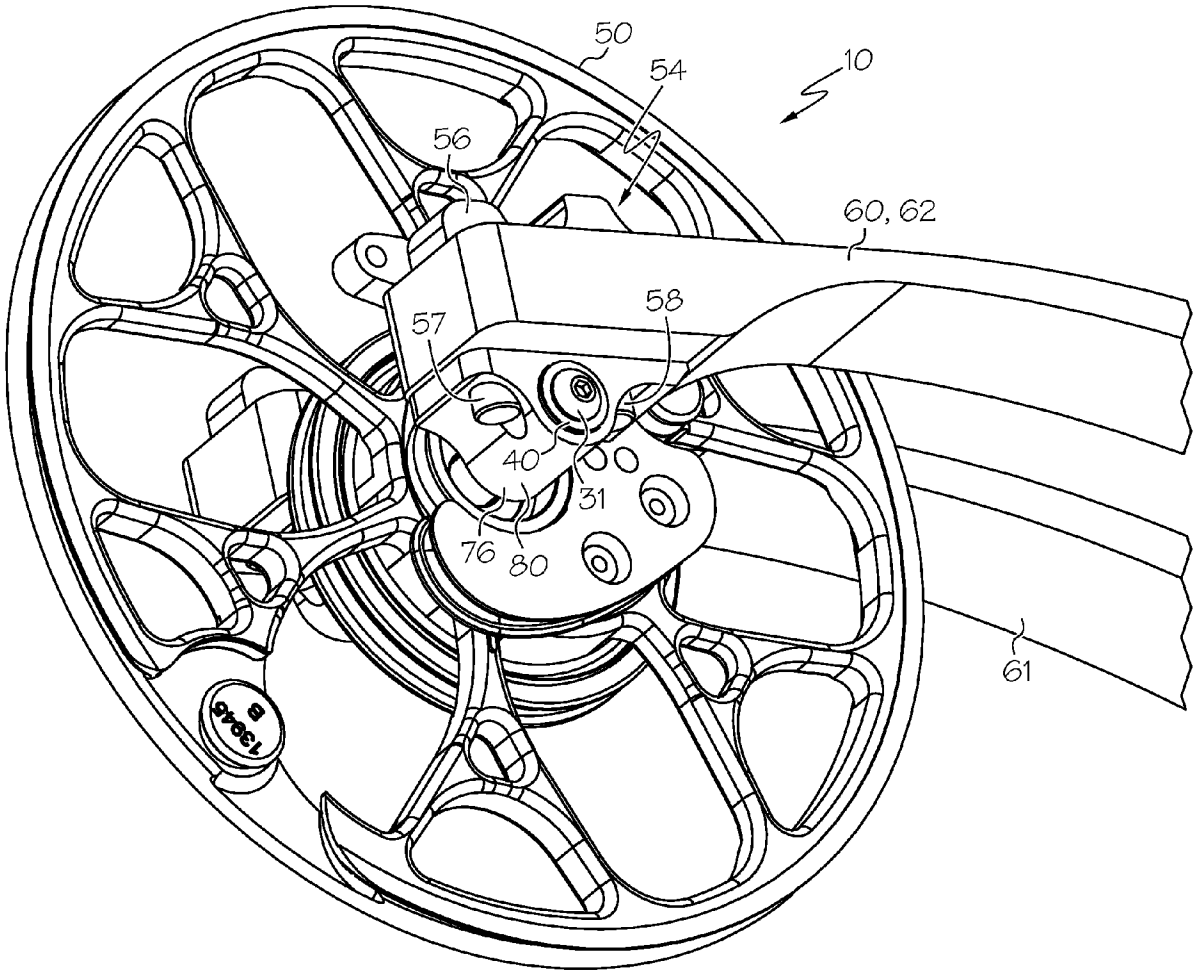
FIG. 15 shows another embodiment of an axle assembly wherein the axle is supported in a pillow block.
Figure 16:
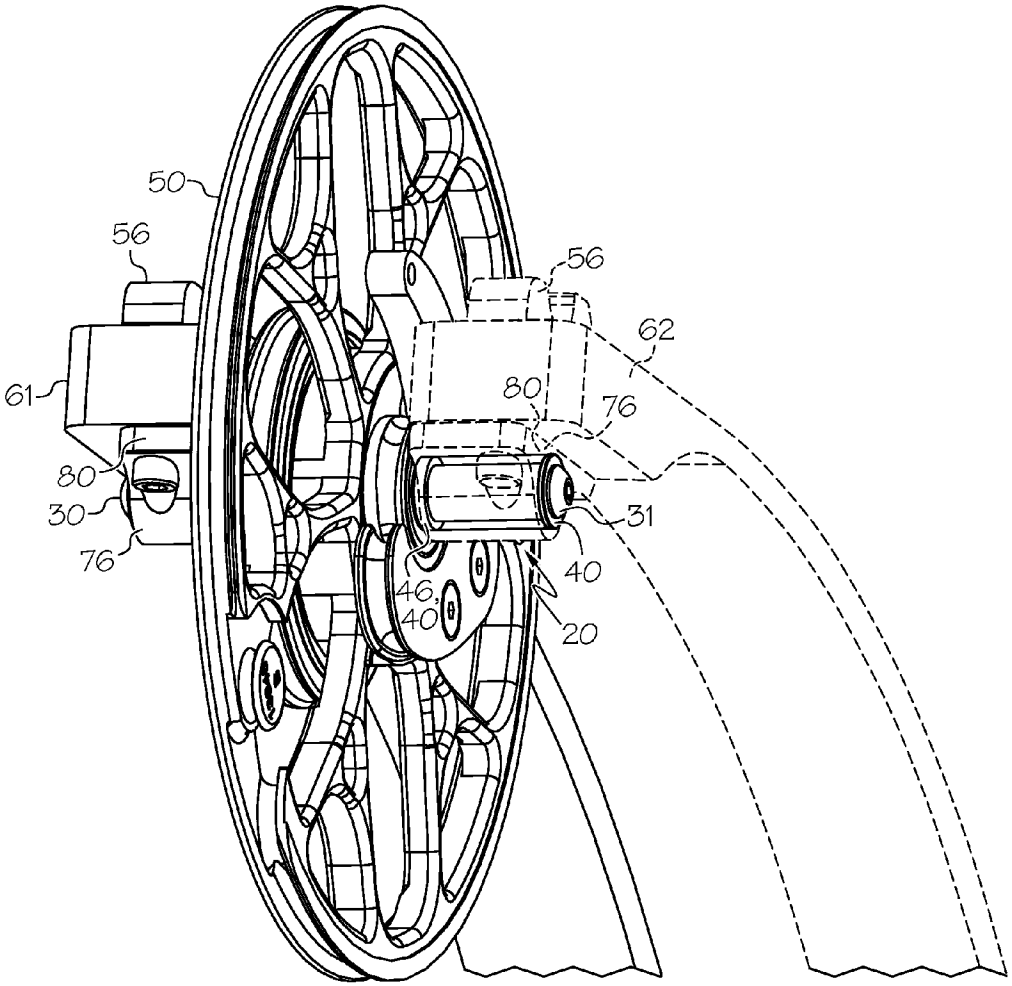
FIG. 16 shows another view of the embodiment shown in FIG. 15.

FIGS. 15 and 16 show another embodiment of an axle assembly 10 wherein the axle shaft 20 is supported in a pillow block 76, and the pillow block 76 is attached to the limb 62.

In some embodiments, a pillow block 76 is incorporated into a reinforcing assembly 54. In some embodiments, a pillow block 76 comprises a distribution plate 80.

When a pillow block 76 is used, the axle shaft 20 as described herein can extend through an aperture in the pillow block 76, and the limb 62 does not include an aperture to receive the shaft 20. Bearing members 40 and flanged bushings 46 as herein described can abut and extend into the pillow block 76 instead of the limb 60.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:
a limb comprising an aperture;
a bushing, at least a portion of said bushing oriented in said aperture;
an axle assembly supported by the limb, said axle assembly comprising:
a shaft comprising a threaded portion; and
a fastener arranged to engage said threaded portion;
a rotatable member comprising a bowstring track, said rotatable member supported by said shaft, said rotatable member arranged to rotate with respect to said shaft;
wherein said shaft extends through said bushing.

2. The archery bow of claim 1, wherein said shaft comprises a cavity and said threaded portion is located inside said cavity.

3. The archery bow of claim 2, wherein said fastener comprises a screw.

4. The archery bow of claim 2, wherein said shaft comprises an integral flange.

5. The archery bow of claim 4, wherein said flange is located opposite said cavity.

6. The archery bow of claim 2, said shaft comprising a second cavity having a second threaded portion.

7. The archery bow of claim 1, wherein said threaded portion comprises threads located on an outer surface of said shaft.

8. The archery bow of claim 7, wherein said fastener comprises a nut.

9. The archery bow of claim 7, wherein said shaft comprises an integral flange.

10. The archery bow of claim 9, wherein said flange is located opposite said threaded portion.

11. The archery bow of claim 7, wherein said shaft comprises a second threaded portion, said second threaded portion comprising external threads.

12. The archery bow of claim 1, said shaft having a length that is less than a width of said limb.

13. The archery bow of claim 1, said bushing comprising a flange located between said limb and said rotatable member.

14. The archery bow of claim 1, wherein said shaft supports a bearing comprising a first portion and a second portion moveable with respect to the first portion, said bushing contacting said second portion, said bushing not contacting said first portion.

15. The archery bow of claim 14, said bushing comprising a tubular portion and a flange, wherein said flange contacts said second portion.

16. The archery bow of claim 1, wherein a length of said bushing occupies a substantial width portion of said limb.

17. The archery bow of claim 1, wherein said shaft supports a rotatable member, the rotatable member being rotatable with respect to said shaft comprising a second bushing, said second bushing oriented between said fastener and said shaft, said second bushing comprising a bushing aperture, a diameter of said bushing aperture being less than a diameter of said shaft.

18. The archery bow of claim 1, wherein said shaft supports a bearing comprising a first portion and a second portion moveable with respect to the first portion, said shaft contacting said second portion, said first portion contacting said rotatable member.

19. The archery bow of claim 18, wherein said rotatable member does not contact said shaft.

20. An archery bow comprising:

a limb;

a pillow block attached to the limb, the pillow block comprising an aperture;

a bushing, at least a portion of said bushing oriented in said aperture;

an axle assembly supported by the limb, said axle assembly comprising:

a shaft comprising a threaded portion; and a fastener arranged to engage said threaded portion;

a rotatable member comprising a bowstring track, said rotatable member supported by said shaft, said rotatable member arranged to rotate with respect to said shaft;

wherein said shaft extends through said bushing.

* * * * *